United States Patent [19]

Neyret

[11] Patent Number: 4,759,204

[45] Date of Patent: Jul. 26, 1988

[54] LOCK MECHANISM

[75] Inventor: Guy Neyret, Francheville, France

[73] Assignee: Neiman S.A., France

[21] Appl. No.: 927,063

[22] Filed: Nov. 5, 1986

[30] Foreign Application Priority Data

Nov. 14, 1985 [FR] France ..... 85 16836

[51] Int. Cl.[4] ..... E05B 27/04

[52] U.S. Cl. ..... 70/360; 70/361; 70/367; 70/369; 70/357

[58] Field of Search ..... 70/360–363, 70/357, 367, 369

[56] References Cited

U.S. PATENT DOCUMENTS

| | | | |
|---|---|---|---|
| 1,929,658 | 10/1933 | Solliday | 70/360 X |
| 2,060,734 | 11/1936 | Knight | 70/361 |
| 2,683,978 | 7/1954 | Jacobi | 70/360 |
| 2,910,860 | 11/1959 | Camba | 70/360 X |
| 3,659,444 | 5/1972 | Wellekens | 70/362 X |
| 3,877,265 | 4/1975 | Schaumberg | 70/360 X |
| 4,099,395 | 7/1978 | Garza | 70/360 |
| 4,196,605 | 4/1980 | Garza | 70/360 |
| 4,266,414 | 5/1981 | Eichenauer | 70/360 X |
| 4,448,050 | 5/1984 | Nugent et al. | 70/360 X |
| 4,516,415 | 5/1985 | Kobayashi | 70/360 X |
| 4,601,184 | 7/1986 | Doinel | 70/360 |

FOREIGN PATENT DOCUMENTS

| | | | |
|---|---|---|---|
| 2713381 | 9/1977 | Fed. Rep. of Germany | 70/360 |
| 2900992 | 7/1980 | Fed. Rep. of Germany | 70/360 |
| 2454499 | 12/1980 | France | 70/360 |

*Primary Examiner*—Gary L. Smith
*Assistant Examiner*—Suzanne L. Dino
*Attorney, Agent, or Firm*—James Creighton Wray

[57] ABSTRACT

A lock mechanism comprises a housing having a bore therein, a sleeve located within said bore, means for indexing said sleeve within said bore at a selected angular disposition in relation to said sleeve, a rotor which is rotatably mounted and axially slidable within said sleeve, said rotor having a longitudinally extending key slot, pistons slidable within bores in said sleeve and rotor between a first position where said sleeve and rotor are coupled together for simultaneous rotation and a second position on insertion of a key in said slot, and a control element for effecting movement of mechanism to be controlled. The rotor is movable axially from a first position where it is disengaged from said control element and a second position where it drivably engages said control element.

3 Claims, 2 Drawing Sheets

LOCK MECHANISM

BACKGROUND TO THE INVENTION

The invention relates to a lock mechanism comprising pistons and a sliding rotor, in which the axial sliding of the rotor engages it with a control element of a lock and/or with an electric switch.

Such a lock mechanism offers the advantage that an attempt at forceful rotation of the rotor does not normally permit of driving the control element, as the rotor is not engaged therewith. However such a lock mechanism can be forced by shearing of the pistons, by applying a sufficient force, whereafter the rotor can slide and be brought into the axial engagement position.

OBJECT OF THE INVENTION

An object of the present invention is to improve a lock mechanism of the initially described type in order to increase its security, especially against forceful rotation.

SUMMARY OF THE INVENTION

According to the invention there is provided a lock mechanism comprising a housing having a bore therein, a sleeve located within said bore, means for indexing said sleeve within said bore at a selected angular disposition in relation to said sleeve, a rotor which is rotatably mounted and axially slidable within said sleeve, said rotor having a longitudinally extending key slot, pistons slidable within bores in said sleeve and rotor between a first position where said sleeve and rotor are coupled together for simultaneous rotation and a second position on insertion of an appropriate key in said slot where said sleeve and rotor are uncoupled, and an operating element for effecting movement of mechanism to be controlled, said rotor being movable axially from a first position where it is disengaged from said control element and a second position where it drivable engages said control element, a piston element axially movable between a first rest position and second position within said casing engaging an end face of the rotor opposite to the key entry slot, and resilient return means for urging said piston element against said end face of the rotor, said piston element and said casing comprising cooperating means for angular coupling of the piston element and casing and said piston element and said operating element comprising cooperating means for angular coupling of the piston element and the operating element when said piston element is in its rest position, said cooperating means for coupling the piston element with the operating element being disengaged when said piston element is moved to its second position on entry of said appropriate key.

With the mechanism according to the invention, any attempt at forcing the lock bolt by rotation of the rotor entrains the socket in rotation and the rotor turns idly without being capable of being displaced axially. For preference the rotor and the socket comprise matching elements for coupling in the rest position, which reinforces the angular fastening of the rotor with the socket.

In a preferred form of embodiment of the invention the rotor and the control element comprise matching coupling elements cooperating with one another in engagement position of the rotor. In this case, according to a particularly advantageous form of embodiment of the invention, the coupling element of the rotor cooperates with a matching element of the socket in the rest position and with a matching element of the control element in the engagement position.

For preference a piston movable axially under the action of elastic return means is pressed upon the face of the rotor opposite to the key entry, ensuring an axial return of the rotor and of the socket through the intermediary of the coupling means, against the forward face of the casing thus forming a common reference face. In this case it is advantageous to provide that the said piston comprises means for angular coupling to the casing and to the control element in the rest position, the said means being disengaged in the engagement position. The control element is thus coupled to the casing in the rest position through the intermediary of the piston, which prevents any direct actuation of the control element.

BRIEF DESCRIPTION OF DRAWINGS

The invention will be clearly understood on reading of the following description given with reference to the accompanying drawing, wherein.

DESCRIPTION OF PREFERRED EMBODIMENT

Figure 2:
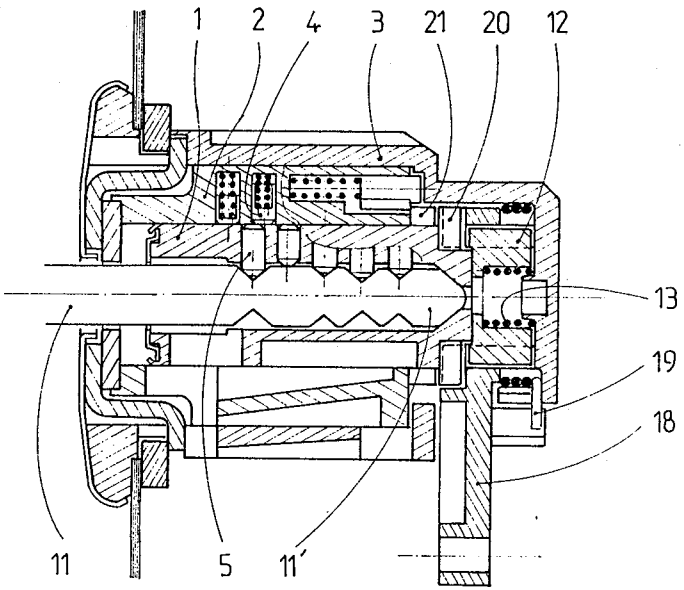
FIG. 2 is a view similar to FIG. 1 in the engagement position.

The lock mechanism according to the invention comprises a rotor 1 pivoting in a sleeve 2 rotatably mounted freely and non-slidingly in a lock casing 3. In the rest position (FIG. 1) the rotor 1 and the sleeve 2 are fast with one another in rotation by means of pairs of pistons 4, 5 thrust by springs 6 towards the key passage 7 of the rotor 1. The sleeve 2 is further indexed at a selected angular disposition in relation to the casing 3 by means of a piston 8 thrust by a spring 9 against a recess 10 of the casing 3.

When the key 11 is introduced (FIG. 2) the pairs of pistons 4, 5 are pushed back against the action of their springs 6, so that the planes of junction of the pairs of pistons 4, 5 are situated in the cylindrical envelope of the rotor 1, which is thus disengaged from the sleeve 2. In this position the thrust of the point 11' of the key 11 against the extremity 7' of the passage 7 produces an axial translational movement of the rotor 1, the pistons 4 and 5 no longer being coaxial. The extremity 1' of the rotor 1 opposite to the entry of the key passage 7 is pressed against a piston 12 thrust against the rotor 1 by a spring 13, so that in the rest position the rotor 1 is pressed against the face of the washer 16, which forms a common reference face for the rotor 1 and the sleeve 2 which is itself thrust by the spring 9 of the piston 8.

Figure 3:
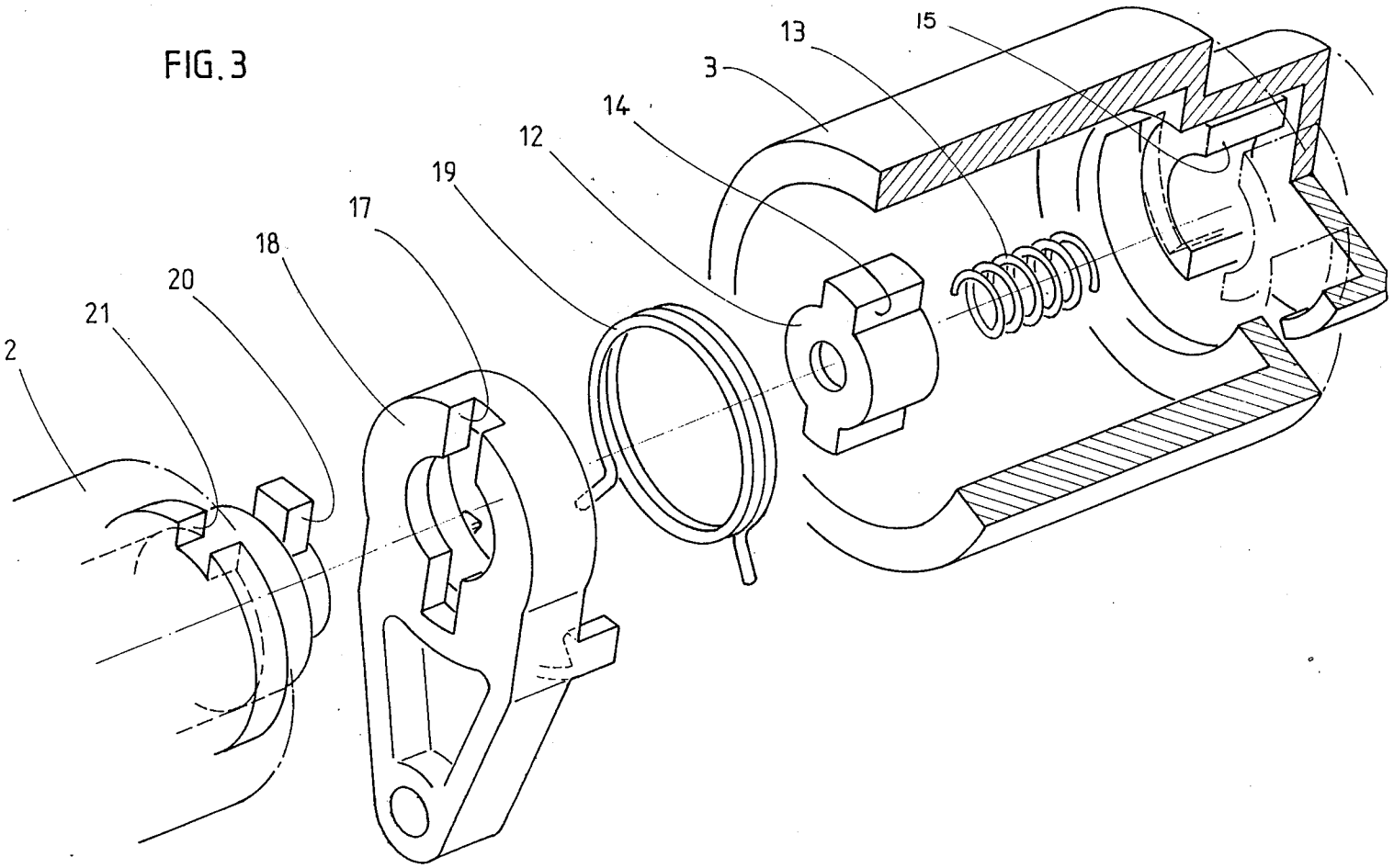
FIG. 3 is a diagrammatic exploded perspective view showing the elements which are to cooperate by coupling and engagement.

The piston 12 is keyed in the casing 3 by radial keys 14 of the piston 12 (FIG. 3) which slide in slots 15 of the casing 3.

In the rest position the said radial keys 14 of the piston 12 are lodged in axial slots 17 of an operating arm 18 which is mounted rotatably but non-slidingly in the casing 3 in relation to which it is thrust angularly by a torsion spring 19. In this rest position the operating arm 18, which is an element for actuation of a lock (not shown), is thus keyed in relation to the piston 12 which is itself keyed in relation to the casing 3. An action upon the operating arm 18, for example through the intermediary of the lock, does not permit unlocking. On the contrary, when the piston 12 is pushed back by the rotor 1 in the course of the axial translational movement of the latter, the keys 14 of the piston 12 escape the slots 17 of the operating arm 18 and the operating arm is free in rotation in relation to the casing 3.

The rotor 1 comprises radial keys 20 which, in the rest position, are engaged in radial slots 21 of the sleeve 2, so that the rotor 1 and the sleeve 2, which plays the part of a conventional lock stator, are made fast in rotation, in addition to the piston pairs 4, 5, by the cooperation of the radial keys 20 with the slots 21.

In the course of the axial translational movement of the rotor 1, the radial keys 20 of the rotor 1 depart from the slots 21 of the sleeve 2 and come to engage in the slots 17 of the operating arm 18, from which slots 17 the keys 14 of the piston 12 depart in the course of the translational movement of the piston 12 produced by the rotor 1, as explained above. At the end of the translational movement of the rotor 1 (FIG. 2) the rotor 1 is thus engaged with the operating arm 18, which is no longer fast with the casing 3 through the intermediary of the piston 12. A rotation of the rotor 1 by the key 11 produces a rotation of the operating arm 18 which controls the lock mechanism.

Figure 1:
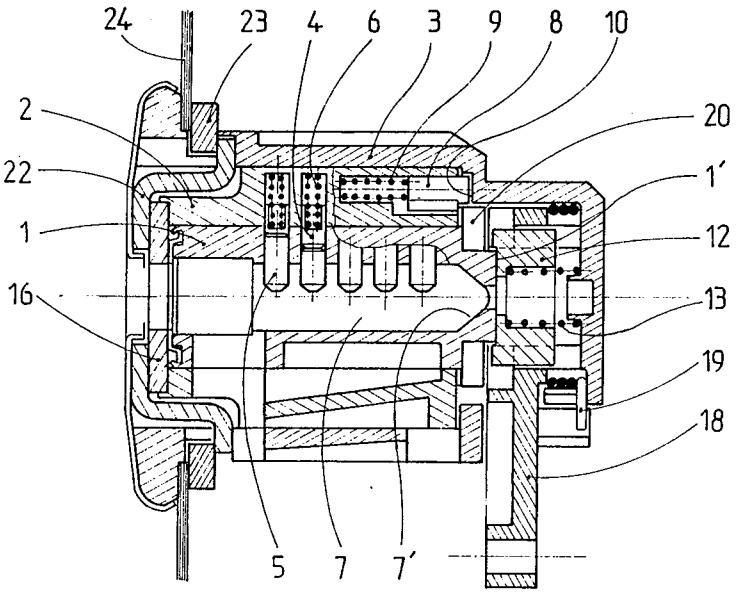
FIG. 1 is a diagrammatic longitudinal sectional view, partially broken away, of a lock according to an example of embodiment of the invention, in the rest position.

The operating arm 18 and the rotor 1 are returned into the angular rest position as soon as the key 11 is released, by the torsion spring 19, and the spring 13 pushes back the piston 12 and the rotor 1 axially towards the rest position according to FIG. 1.

By way of security against frontal drilling, the invention foresees masking the front face of the sleeve 2 by a treated steel washer 16 protecting the key entry and a dome 22 of treated steel inset in the casing 3 and upon which there bears a fork 23 for retaining the bolt, thus bolting the dome 22 behind the door panel 24.

The washer 16 protecting the rotor 1 overlaps the latter radially in order to press upon the sleeve 2, which increases the resistance of the rotor 1 to frontal shocks, which without this arrangement would directly thrust the pistons.

I claim:

1. A lock mechanism comprising (a) a housing (3) having a bore therein, (b) a sleeve (2) located within said bore, (c) means (9) for indexing said sleeve within said bore at a selected angular disposition in relation to said sleeve, (d) a rotor (1) which is rotatably mounted and axially slidable within said sleeve, said rotor having a longitudinally extending key slot, (e) pistons slidable within bores in said sleeve and rotor between a first position where said sleeve and rotor are coupled together for simultaneous rotation and a second position on insertion of an appropriate key in said slot where said sleeve and rotor are uncoupled, and (f) an operating element (18) for effecting movement of mechanism to be controlled, said rotor (1) being movable axially from a first position where it is disengaged from said operating element and a second position where it drivably engages said operating element, (g) a piston element axially movable between a first rest position and second position within said casing engaging an end face of the rotor opposite to the key entry slot, and (h) resilient return means for urging said piston element against said end face of the rotor, said piston element and said casing comprising cooperating means for angular coupling of the piston element and casing and said piston element and said operating element comprising cooperating means for angular coupling of the piston element and the operating element when said piston element is in its rest position, said cooperating means for coupling the piston element with the operating element being disengaged when said piston element is moved to its second position on entry of said appropriate key.

2. A lock mechanism according to claim 1, wherein the front face of the socket is masked by a treated steel dome in the casing, upon which a bolt-retaining fork presses.

3. A lock mechanism according to claim 1, wherein a washer for protecting the rotor is mounted pressing upon the said socket.

* * * * *